United States Patent [19]

Ahlgren

[11] 3,940,109

[45] Feb. 24, 1976

[54] LIFTING DEVICE FOR RAISING, LOWERING AND SUSPENDING HEAVY LOADS

[76] Inventor: Nils Harald Ahlgren, Skyttevagen 22, 133 00 Saltsjobaden, Sweden

[22] Filed: Jan. 29, 1975

[21] Appl. No.: 545,198

[30] Foreign Application Priority Data

Jan. 30, 1974 Sweden ..... 7401176
Mar. 14, 1974 Sweden ..... 7403403

[52] U.S. Cl. ..... 254/106
[51] Int. Cl.[2] ..... B66F 1/00
[58] Field of Search ..... 254/29 A, 76, 105–107

[56] References Cited

UNITED STATES PATENTS

| | | | |
|---|---|---|---|
| 3,096,075 | 7/1963 | Brown | 254/106 |
| 3,203,669 | 8/1965 | Johansson | 254/107 |
| 3,556,480 | 1/1971 | Johansson | 254/105 |
| 3,844,023 | 9/1972 | Surribas et al. | 254/29 A |

*Primary Examiner*—Al Lawrence Smith
*Assistant Examiner*—Robert C. Watson

[57] ABSTRACT

A lifting device for raising, lowering and suspending heavy loads comprises a climbing jack with alternating gripping means and a lifting element. For allowing repeated cooperation with the gripping means the lifting element consists of a plurality of outer wire elements and at least one inner wire element, where the elasticity of at least one inner wire element is greater than the elasticity of the outer wire elements. Usually, the outer wire elements are arranged in groups, with spaces between the groups.

A gripping device for a lifting element passed therethrough comprises a double-acting piston within a cylinder, with a plurality of jaw elements therein. The jaw elements are wedge shaped at their side remote from the lifting element, and are held between pairs of guides formed in the cylinder for radial movement only. The piston carries correspondingly wedge-shaped elements, so that longitudinal movement of the piston results in radial movement of the jaws.

5 Claims, 4 Drawing Figures

LIFTING DEVICE FOR RAISING, LOWERING AND SUSPENDING HEAVY LOADS

The invention relates to a lifting device for raising, lowering and suspending heavy loads.

Climbing jacks whose gripping means alternately engage a lifting element in the form of a wire rope, by reason of the repeated engagement of their gripping means with the wire rope tend to cause a displacement of the inner wire elements with respect to the outer wire elements of the wire rope, and as a result of the displacements being added to each other a bulge may be formed in the outer wire elements of the wire rope. These displacements are primarily due to the fact that the engagement of the gripping means is realized by wedge-shaped elements which are successively pressed into engagement with the wire rope in conjunction with a movement in the longitudinal direction of the lifting element.

The present invention has for its object to eliminate the effect of said displacements or to prevent said displacements.

The invention thus relates to a lifting device for raising, lowering and suspending heavy loads comprising a climbing jack with alternating gripping means and a lifting element, where the lifting element for allowing repeated co-operation with the gripping means consists of a plurality of outer wire elements and at least one inner wire element, and where the elasticity of said at least one inner wire element is greater than the elasticity of said outer wire elements. This lifting device will consequently eliminate the effect of said displacements.

The invention also relates to a gripping device for gripping engagement with a load-bearing lifting element passed therethrough, and having a plurality of releasable jaw means adapted to grip said lifting element. The improvement in the gripping device comprises a double-acting piston and cylinder means; guide means carried by said cylinder means; the side of each of said releasable jaw means remote from said lifting element being generally wedge-shaped; correspondingly wedge-shaped elements carried by said piston and adapted to slidably contact said sides of said jaw means remote from said lifting elements; said releasable jaw means being radially movable between co-operating pairs of said guide means; and means for communicating either side of said piston within said cylinder to a source of pressure medium; so that longitudinal movement of said piston and said wedge-shaped elements within said cylinder results in radial movement of said releasable jaw means within said cylinder for gripping engagement or release thereof with a lifting element passed through said gripping device.

A gripping device according to this invention can be arranged with other similar gripping devices in a climbing jack arrangement, where each gripping device forms one of the gripping elements of the climbing jack. A climbing jack of such a construction will prevent the wire elements of the wire rope from being so displaced with respect to each other that a bulge is formed. Incorporation of said climbing jack in the lifting device which except for the jack includes the wire rope, where the outer and inner wire elements are of different elasticity, ensures that the contemplated effects will be achieved.

These and other objects, features and advantages of the present invention are discussed in greater detail hereafter, in association with the accompanying drawings, in which.

Figure 1:
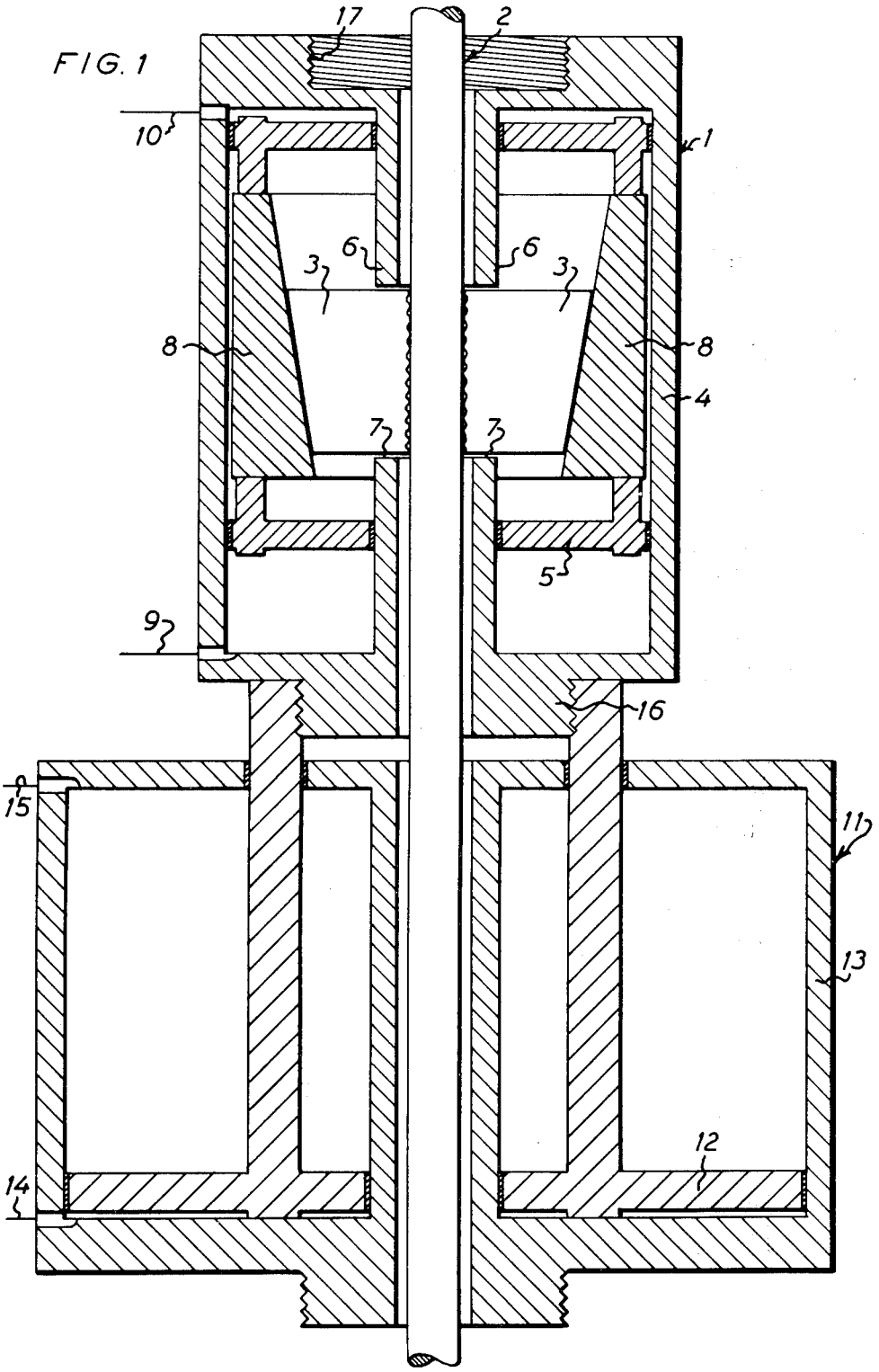
FIG. 1 is a longitudinal cross-section of a gripping device and a lifting element co-operating therewith.

In the figures, the reference numeral 1 indicates a gripping device according to this invention. The gripping device includes a plurality of gripping jaws 3 which are symmetrically arranged around the lifting element 2 which passes through the gripping device 1. The gripping jaws are releasable with respect to the lifting element 2 so that upon operation of the gripping element the releasable jaws 3 have a gripping engagement with the lifting element or release therefrom. The releasable jaws 3 are operable through the action of a double acting hydraulic piston means 5, as discussed in greater detail hereafter.

The gripping device 1 also comprises a cylinder 4, within which the piston 5 is displaceable so as to effect the operation of the releasable jaws 3. Within the cylinder 4 there are guide means 6 and 7 which preclude movement of the releasable jaws 3 longitudinally of the lifting element 2, thereby assuring that the releasable jaws 3 are moveable in a lateral or radial direction with respect to the lifting element 2. The guide means 6 and 7 preclude movement of the releasable jaws 3 in a longitudinal movement with respect to the cylinder 4.

The piston 5 within the cylinder 4 carries with it a plurality of generally wedge-shaped elements 8. It will be noted that the outer sides of the releasable jaws 3 which are remote from the lifting element 2 are wedge-shaped, and the wedge elements 8 have a corresponding shape. The wedge elements 8 are such that they would normally form a cone, and they interfere with the correspondingly sloping or wedge-shaped faces of the releasable jaws 3 so that as the piston 5 is displaced within the cylinder 4, the wedge elements 8 are also displaced in a longitudinal direction with respect to the cylinder 4 and the lifting element 2, and the releasable jaws 3 are displaced in a lateral or radial direction with respect to the lifting element 2 and the cylinder 4.

Displacement of the piston 5 within the cylinder 4 is effected by connecting the cylinder 4 to a source of pressure medium through pipes 9 and 10. A special medium is introduced into the cylinder 4 through pipe 9 from the pressure medium source, a gripping action of the releasable jaws 3 against the lifting element 2 is effected; and when the pressure medium is introduced into the cylinder 4 from the pressure medium source through pipe 10, a releasing action of the releasable jaws 3 with respect to the lifting element 2 is effected. It is seen, therefore, that the gripping and releasing of the releasable jaws 3 from the lifting element 2 are independent of the load; and rely solely upon the operation and supply of the pressure medium to the cylinder 4 at either side of the piston 5. Because the gripping and releasing operations of the gripping device 1 are independent of the load, the cone which is formed by the wedge elements 8 and the corresponding cone at the outer sides of the releasable jaws 3 may be inverted. An advantage is gained in that the cone cannot come loose because of vibration or shaking of the gripping device 1.

As shown in FIG. 1, the gripping device 1 is arranged on an hydraulic jack 11. The jack 11 comprises a double-acting piston 12 moveable within the cylinder 13. The cylinder 13 is connected to a pressure medium source by pipes 14 and 15; and obviously the operation of the jack device 11 is independent of the load and may be operated independently of the operation of a gripping device 1. The jack device 11 is also provided with a central passage to accommodate the lifting element 2, which is passed therethrough.

Figure 2:
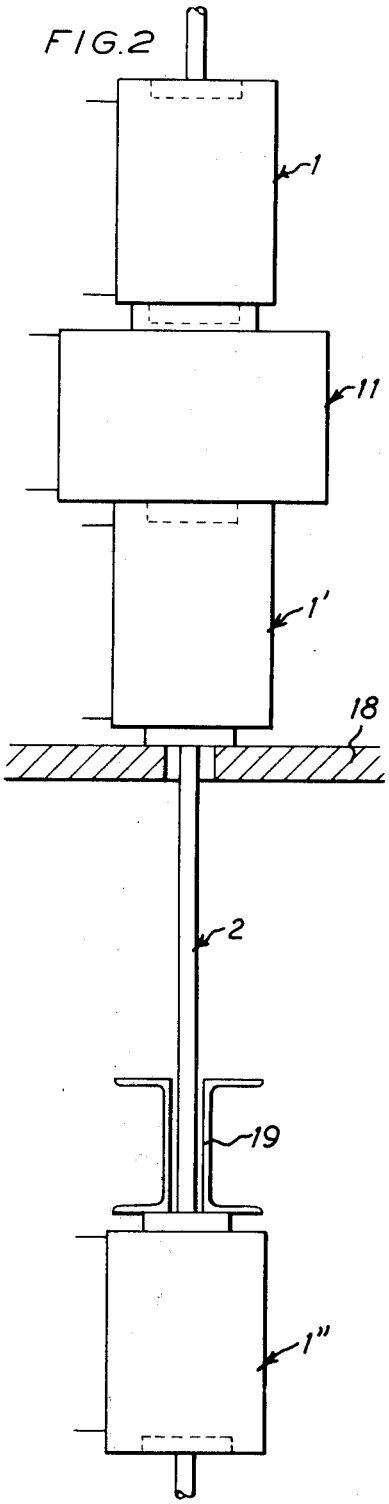
FIG. 2 is a side elevation of a climbing jack assembly and a load being supported on a gripping device secured to a lifting element.

A climbing jack device can be arranged in the manner illustrated in FIGS. 1 and 2, by securing a gripping device 1 to the top of the jack device 11 as shown in FIG. 2, and a further gripping device 1' — which is substantially identical with gripping device 1 — to the bottom of the jack device 11. By so doing, a complete climbing jack is arranged. The gripping devices 1 and 1' are secured to the jack device 11 by mating threaded parts, where each of the gripping devices has a threaded male part 16 and a threaded female part 17. Thus, the jack device 11 is secured to the upper gripping device 1 by having the cylinder 4 thereof secured to the piston 12 of the jack device; and the cylinder 13 of the jack device 11 is secured to the cylinder 4 of the lower gripping device 1'. Incorrect or faulty connections between the jack device 11 and the gripping devices 1 and 1' are thereby precluded.

Referring to FIG. 2, it will be noted that the climbing jack which comprises the jack device 11 and the gripping devices 1 and 1' rests on a rigid member 18, which may be a part of a structure being built or the supporting construction therefor. In any event, the rigid member 18 is rigid relative to the load 19 which is lifted or lowered on the lifting element 2. The load 19 is arranged to be supported on the lifting element 2 by a gripping device 1'' — which is identical to the gripping device 1 discussed above — so that the load 19 rests upon the gripping device 1''. The load 19 may thereby be lifted by the climbing jack comprising the jack device 11 and the gripping devices 1 and 1'. Usually, several identical climbing jack assemblies are hydraulically connected together, and are arranged adjacent each other for lifting the load 19. In such circumstances, of course, each of the lifting elements 2 must be provided with a load-carrying gripping device 1''.

The operation of the climbing jack assembly of jack device 11 and gripping devices 1 and 1' is obvious. Operation of the jack device 11 and either of the gripping devices results in a relative longitudinal displacement of the gripping devices 1 and 1', one from the other. Thus, if the lower gripping device 1' is operated to release from the lifting element 2, and the upper gripping device 1 is operated to grippingly engage the lifting element 2, and at the same time the jack device 11 is operated so as to extend the upper portion of the piston 12 which is mated to the cylinder 4 of the gripping device 1, the gripping device 1 lifts the load 19 as it displaces upwardly away from the gripping device 1'. Thereafter, the gripping device 1' is caused to have a gripping relation with the lifting element 2, and the gripping device 1 is released therefrom, and the piston 12 is driven downwardly in the jack device 11 with the load 19 remaining stationary. Another climbing operation can then ensue, whereby the load 19 would again be lifted. It is seen that the operation of the releasable jaws 3 in each of the gripping devices 1 and 1' is independent of the load 19, and does not rely upon the load 19 for gripping force.

Figure 3:
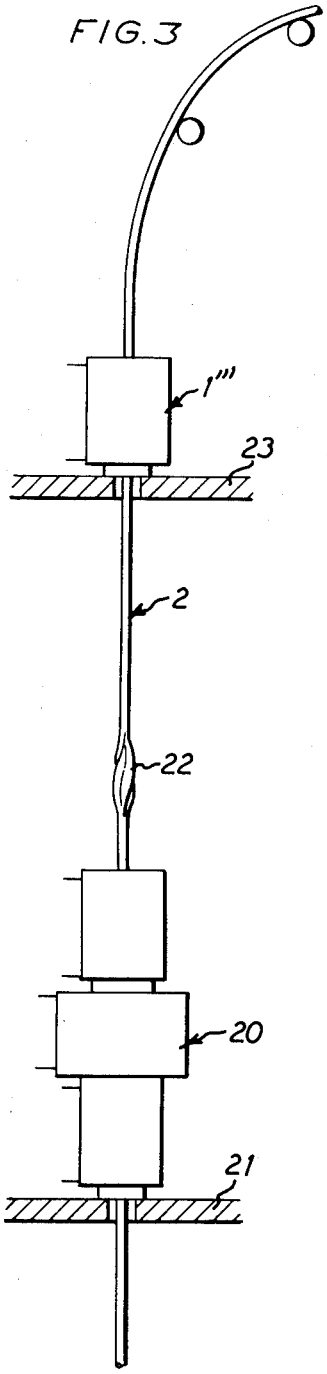
FIG. 3 is a side view with an assembly similar to that of FIG. 2, together with a further gripping device co-operating with the lifting element.

Turning now to FIG. 3, there is shown a climbing jack assembly of the same sort discussed above with respect to FIG. 2, and marked generally with the numerical designation 20. The climbing jack assembly 20 may also be of conventional design, such as that taught in applicant's U.S. Pat. No. 3,685,801 dated Aug. 22, 1972. In the arrangement of FIG. 3, the climbing jack assembly 20 is supported by the rigid member or firm structure 21, and co-operates with a lifting element 2 which consists of a multiple wire element wire rope or wire strand, which is spiral wound. There is a bulge 22 above the climbing jack assembly 20, which is caused by a displacement in the longitudinal direction of the lifting element 2 of the inner wire elements with respect to the outer wire elements. The present invention alleviates and helps to overcome the difficulties encountered when a bulge 22 occurs in the lifting element. It will be noted in the arrangement of FIG. 3 that above the climbing jack assembly 20 and the bulge 22 the lifting element 2 passes through a further gripping device 1''' — which is identical to the gripping devices discussed above. The gripping device 1''' rests on or is supported by a rigid member 23.

The bulge 22 in the lifting element 2 is caused, at least in part, in any climbing jack device when ring stress or segmented arch stress is applied to a lifting element such as a wire rope or wire strand. A hoop stress may be caused in the outer wire elements or strands, and relative displacement of the inner wire elements or strands with respect to the outer wire elements or strands may be caused by the weight of the load carried by the lifting element. If the gripping device 1''' is operated so as to be engaged with the lifting element 2 at regular intervals, and the climbing jack assembly 20 is opened, the gripping device 1''' will thereby carry the entire load and all of the wire elements or strands of the lifting element 2 can take up load, thereby eliminating the bulge 22. The number of climbing operations for the jack assembly 20 between operations of the gripping device 1''' to eliminate any bulges 22 which might occur must be determined empirically, but it normally is about ten or twenty climbing operations.

In an alternative arrangement to that shown in FIG. 3, the gripping device 1''' does not need to be supported on a rigid member 23, but it can be arranged over spacing means secured to the jack assembly 20 above the bulge 22. Spacers can also be arranged to cause contact between the jack assembly 20 and the gripping device 1''' periodically, at which the time the gripping device 1''' is operated and the bulge 22 eliminated.

Figure 4:
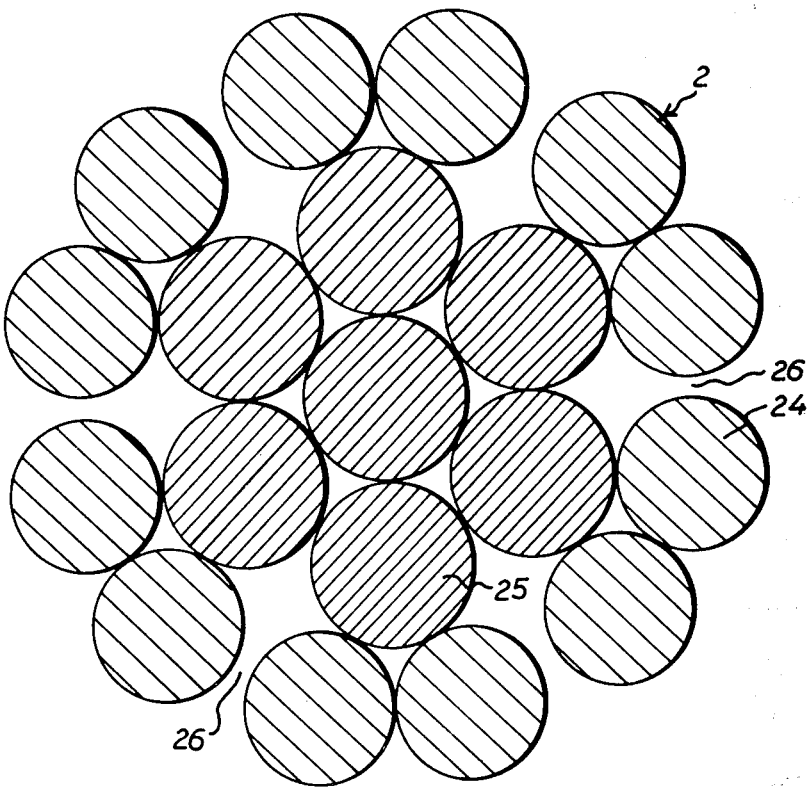
FIG. 4 is a cross-section of a lifting element according to this invention.

Turning now to FIG. 4, there is shown the cross-section of a preferred embodiment of a lifting element which according to this invention is adapted to be used in combination with a climbing jack with alternating gripping means. The climbing jack preferably comprises gripping devices 1 as taught herein. The lifting element is a spiral-wound wire rope or wire strand; and is ideally illustrated as being a wire strand where each of the wire elements is shown in cross-section in FIG. 4.

The lifting element 2 comprises at least one inner wire element 25 and a plurality of outer wire elements 24. The inner wire elements 25 are formed of a material having a higher elasticity than the outer wire elements 24, so that relative displacement of the outer wire elements 24 and the inner wire elements 25 may be compensated. In a preferred embodiment, the outer wire elements 24 are steel, and the inner wire elements 25 are aluminium. Obviously, a number of other combinations of suitable metals may be provided, where the elasticity of the inner wire elements is greater than the elasticity of the outer wire elements. The different elasticities of the wire elements 24 and 25 are shown in FIG. 4 by different cross-hatchings with respect to each.

As shown in FIG. 4, the outer wire elements 24 are so arranged in relationship to the inner wire elements 25 that there is at least one space 26 between adjacent outer wire elements 24. Again, in the preferred embodiment, the outer wire elements 24 are arranged in groups with spaces 26 between each of the groups. Each of the groups may consist of two or more wire elements 24.

To more easily assure the provision of the openings 26 between groups of outer wire elements 24, the diameters of the inner wire elements and outer wire elements are arranged to be different. As shown, the diameters of each of the inner wire elements 25 are greater than the diameters of the outer wire elements 24.

The number of outer wire elements is so chosen with respect to the number of inner wire elements that at least one space is formed between adjacent outer wire elements. In the preferred embodiment shown in FIG. 4 the number of outer wire elements is chosen so that each group of outer wire elements is adjacent a single inner wire element 25.

When ring stress or segmented arch stress is applied to a lifting element 2 according to this invention, the outer wire elements 24 are forced into the inner wire elements 25. If a bulge 22 occurs in a lifting element, as discussed above, the inner wire elements 25 have a greater elasticity and thereby a greater capacity for elongation than the outer wire elements, and when a gripping element above the bulge is secured to the lifting element so that the load is picked up by all of the wire elements of the lifting element to eliminate the bulge 22, a slight elongation of the inner wire elements having higher elasticity may occur.

To be certain that the intended effect of the lifting element according to this invention is obtained upon repeated use of the lifting element 2, the lifting element should pass through a climbing jack assembly in the same direction each time that it is used.

There has been described a gripping device for use with lifting elements which carry heavy loads, whereby the loads may be lifted, lowered or suspended from above; and a lifting element which is particularly adapted for such use. Modifications, alterations and amendments to the precise embodiments discussed above may, of course, be made without departing from the spirit and scope of the appended claims.

What I claim and desire to secure by Letters Patent is:

1. A lifting device for raising, lowering and suspending heavy loads comprising a climbing jack with alternating gripping means and a lifting element, where the lifting element for allowing repeated co-operation with the gripping means consists of a plurality of outer wire elements and at least one inner wire element, where the elasticity of at least one inner wire element is greater than the elasticity of the outer wire elements.

2. The lifting device of claim 1 where the outer wire elements are so arranged as to have at least one space between adjacent outer wire elements.

3. The lifting device of claim 2 where the outer wire elements are arranged in groups, with spaces between said groups.

4. The lifting device of claim 2 where the diameters of the inner and outer wire elements are different.

5. The lifting device of claim 2 where the number of outer wire elements is so chosen with respect to the number of inner wire elements that at least one space is formed between adjacent outer wire elements.

* * * * *